US009282413B2

(12) United States Patent
Lim et al.

(10) Patent No.: US 9,282,413 B2
(45) Date of Patent: Mar. 8, 2016

(54) APPARATUS AND METHOD FOR AUTOMATIC AUDIO SYSTEM AND RECOVERY FROM UNEXPECTED BEHAVIORS

(71) Applicant: Intel Corporation, Santa Clara, CA (US)

(72) Inventors: Meoung-Jin Lim, San Diego, CA (US); Sanghyun Chi, San Diego, CA (US); Wendeline Ruth Avis, San Diego, CA (US)

(73) Assignee: Intel Corporation, Santa Clara, CA (US)

( * ) Notice: Subject to any disclaimer, the term of this patent is extended or adjusted under 35 U.S.C. 154(b) by 14 days.

(21) Appl. No.: 14/312,237

(22) Filed: Jun. 23, 2014

(65) Prior Publication Data

US 2015/0023508 A1 Jan. 22, 2015

Related U.S. Application Data

(60) Provisional application No. 61/846,702, filed on Jul. 16, 2013.

(51) Int. Cl.
*H04R 29/00* (2006.01)
*H04R 3/04* (2006.01)

(52) U.S. Cl.
CPC . *H04R 29/00* (2013.01); *H04R 3/04* (2013.01)

(58) Field of Classification Search
CPC .... H04R 29/00; H04R 29/004; H04R 29/001; H04R 1/1091; H04R 3/00; H04R 5/04; H04R 1/1041
USPC ..... 381/58
See application file for complete search history.

(56) References Cited

U.S. PATENT DOCUMENTS

| | | | | |
|---|---|---|---|---|
| 8,280,062 | B2 * | 10/2012 | Fukuda | H04R 29/00 381/58 |
| 8,693,700 | B2 * | 4/2014 | Bakalos | G10K 11/178 381/58 |
| 8,704,533 | B2 * | 4/2014 | Quan | G01R 23/20 324/620 |
| 8,755,533 | B2 * | 6/2014 | Banerjee | H04R 25/70 381/314 |
| 2015/0098577 | A1 * | 4/2015 | Moore | G01H 9/00 381/58 |

* cited by examiner

*Primary Examiner* — Mark Blouin
(74) *Attorney, Agent, or Firm* — Forefront IP Lawgroup, PLLC

(57) ABSTRACT

An automatic audio recovery system in a mobile device is provided. The system includes one or more status generators and an audio path recovery handler. The one or more status generators are configured to monitor operation of audio path elements within the mobile device, and are configured to detect and report one or more abnormal audio operations to an audio status monitor, where, responsive to one or more reports corresponding to the one or more abnormal audio operations, the audio status monitor requests automatic recovery of the audio path elements. The audio path recovery handler is configured to receive an automatic recovery request from the audio status monitor, and is configured to responsively direct reset elements corresponding to the audio path elements to automatically initialize the audio path elements to a stable state.

21 Claims, 9 Drawing Sheets

PRESENT DAY MOBILE STATION

METHOD FOR MONITORING AUDIO STATUS

*METHOD FOR MONITORING INTERRUPT SERVICE REQUEST (ISR) STATUS*

*METHOD FOR MONITORING PULSE CODE MODULATION (PCM) STATUS*

*METHOD FOR MONITORING PACKET (PKT) STATUS*

APPARATUS AND METHOD FOR AUTOMATIC AUDIO SYSTEM AND RECOVERY FROM UNEXPECTED BEHAVIORS

CROSS-REFERENCE TO RELATED APPLICATIONS

This application claims the benefit of the following U.S. Provisional Application, which is herein incorporated by reference for all intents and purposes.

| SERIAL NUMBER | FILING DATE | TITLE |
|---|---|---|
| 61846702 (VTU.12-0044-US) | Jul. 16, 2013 | APPARATUS FOR AUTOMATIC AUDIO SYSTEM RECOVERY FROM UNEXPECTED BEHAVIORS |

BACKGROUND OF THE INVENTION

1. Field of the Invention

This invention relates in general to the field of telecommunications, and more particularly to an apparatus and method in a mobile station for automated audio recovery from unexpected behaviors.

2. Description of the Related Art

The cell phone industry is undergoing exponential growth, not only in this country, but all over the world. In fact, it is well known that the over twenty percent of the adult population in the United States do not even have a traditional landline telephone. In addition to those who do not own a conventional telephone, nearly ninety percent of the adult population owns a wireless phone.

And the usage of cell phones is increasing as well over the use of traditional landline telephone coverage. In fact, one in seven adults now uses only cell phones. Whereas in the past cell phones were used when a landline was not available or under emergency conditions, lower carrier rates, affordability of family packages, and free mobile-to-mobile or friend-to-friend promotions have fostered in significant increases in usage. It is not uncommon today to walk into any public forum or facility and notice a majority of the people there talking on their cell phones.

In fact, there is a substantial pull on cell phone developers to quickly field new models, and the competition in sales is unparalleled. Consequently, it is not uncommon for a developer to field a new model with relatively immature software and to provide software updates when significant bug fixes and feature enhancements are developed.

The audio path within a cell phone presents a significant challenge in that sound pressure waves are transmitted and received by a microphone and speaker, which provide for a conversion interface between these transducers and analog electrical signals. And the analog electrical signals are converted to/from digital signals by converters such as analog-to-digital converters (ADCs) and digital-to-analog converters (DACs). Other elements within the audio path of the cell phone operate upon the digital signals, ultimately ending up with a series of modulated signals that are transmitted over an air interface.

As one skilled in the art will appreciate, the conversion of analog electrical signals to digital signals that are representative of those analog electrical signals, and vice versa, is complex, and when dealing with analog signals corresponding to changing audio conditions, conversion between these two domains is exceedingly complicated because configuration of the conversion elements and other elements within the cell phone must dynamically adapt to the changing audio conditions. If fielded software in the cell phone is mature, then it is anticipated that audio processing in the cell phone will be problem free. But if the software is immature or in an intermediate state, a user may occasionally experience conditions where signal shift or improper configuration of the conversion elements results in overwhelming noise heard over the speaker or a complete mute of audio altogether.

Though infrequent, when abnormal audio path conditions occur, the only recourse that a user has in a present day cell phone is to power cycle the phone, which usually clears the problem conditions. However, to require a user to power cycle his/her cell phone is annoying and cumbersome.

Accordingly, what is needed is a mechanism in a cell phone that provides for automatic recovery from unexpected audio subsystem behaviors.

SUMMARY OF THE INVENTION

The present invention, among other applications, is directed to solving the above-noted problems and addresses other problems, disadvantages, and limitations of the prior art. The present invention provides a superior technique for recovering from unexpected audio subsystem errors in a mobile station.

In one embodiment, an automatic audio recovery system in a mobile station is provided. The system includes one or more status generators and an audio path recovery handler. The one or more status generators are configured to monitor operation of audio path elements within the mobile station, and are configured to detect and report one or more abnormal audio operations to an audio status monitor, where, responsive to one or more reports corresponding to the one or more abnormal audio operations, the audio status monitor requests automatic recovery of the audio path elements. The audio path recovery handler is configured to receive an automatic recovery request from the audio status monitor, and is configured to responsively direct reset elements corresponding to the audio path elements to automatically initialize the audio path elements to a previously known stable state.

One aspect of the present invention contemplates an automatic audio recovery system in a mobile station. The system has an audio signal processor (ASP) and a control processor. The ASP includes one or more status generators that are configured to monitor operation of audio path elements within the mobile station, and that are configured to detect and report one or more abnormal audio operations to an audio status monitor, where, responsive to one or more reports corresponding to the one or more abnormal audio operations, the audio status monitor requests automatic recovery of the audio path elements. The control processor includes an audio path recovery handler, that is configured to receive an automatic recovery request from the audio status monitor, and that is configured to responsively direct reset elements corresponding to the audio path elements to automatically initialize the audio path elements to a previously known stable state.

Another aspect of the present invention comprehends a method for automatic recovery from unexpected audio path behaviors in a mobile station. The method includes: via one or more status generators, first monitoring operation of audio path elements within the mobile station, and first detecting and first reporting one or more abnormal audio operations to an audio status monitor, where, responsive to one or more reports corresponding to the one or more abnormal audio operations, the audio status monitor requests automatic recovery of the audio path elements; and via an audio path recovery handler, receiving an automatic recovery request from the audio status monitor, and responsively directing reset elements corresponding to the audio path elements to automatically initialize the audio path elements to a previously known stable state.

BRIEF DESCRIPTION OF THE DRAWINGS

These and other objects, features, and advantages of the present invention will become better understood with regard to the following description, and accompanying drawings where.

DETAILED DESCRIPTION

Figure 1:
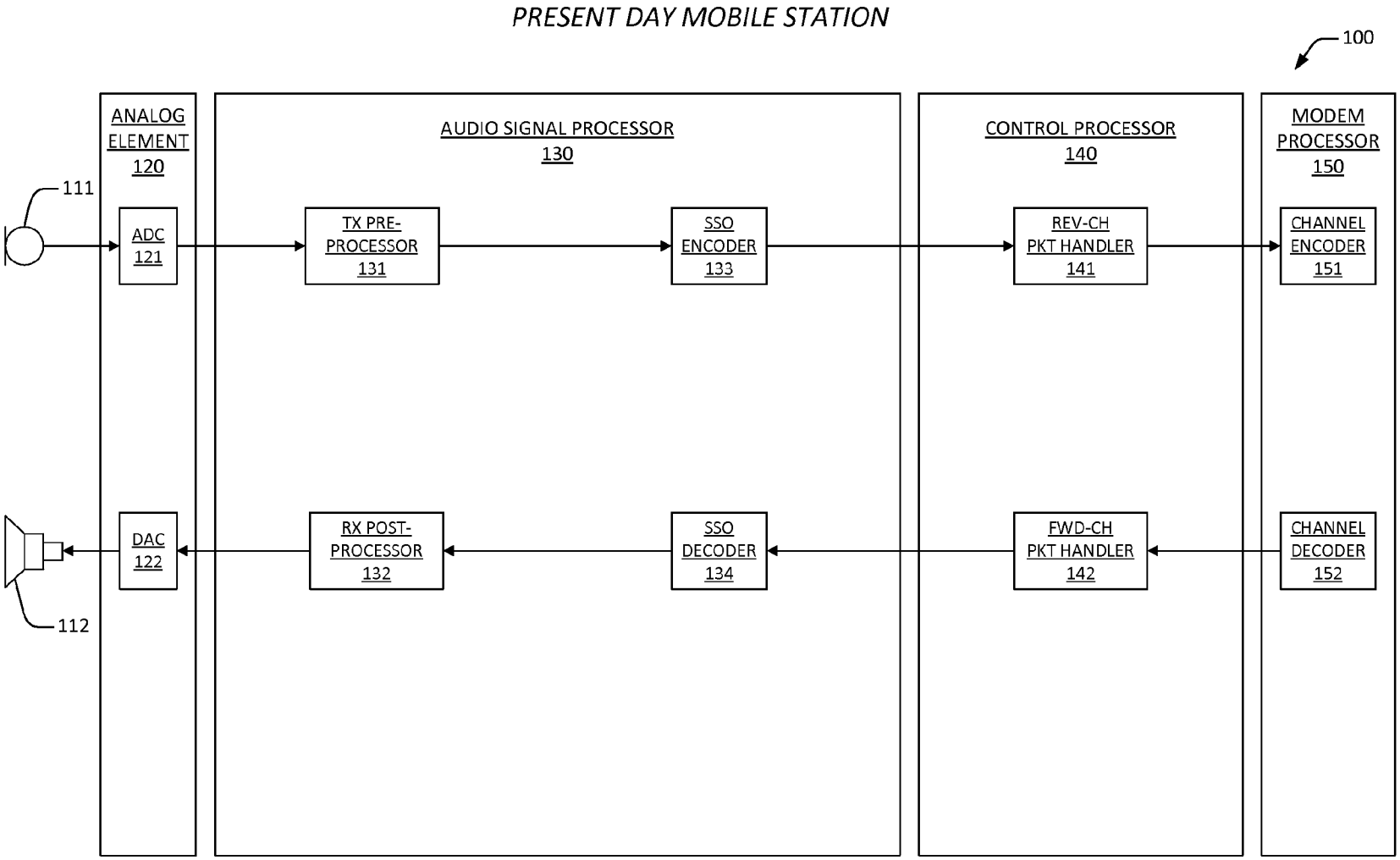
FIG. 1 is a block diagram illustrating an exemplary audio subsystem disposed within a present day mobile station.

Exemplary and illustrative embodiments of the invention are described below. In the interest of clarity, not all features of an actual implementation are described in this specification, for those skilled in the art will appreciate that in the development of any such actual embodiment, numerous implementation specific decisions are made to achieve specific goals, such as compliance with system related and business related constraints, which vary from one implementation to another. Furthermore, it will be appreciated that such a development effort might be complex and time consuming, but would nevertheless be a routine undertaking for those of ordinary skill in the art having the benefit of this disclosure. Various modifications to the preferred embodiment will be apparent to those skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

The present invention will now be described with reference to the attached figures. Various structures, systems, and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase (i.e., a definition that is different from the ordinary and customary meaning as understood by those skilled in the art) is intended to be implied by consistent usage of the term or phrase herein. To the extent that a term or phrase is intended to have a special meaning (i.e., a meaning other than that understood by skilled artisans) such a special definition will be expressly set forth in the specification in a definitional manner that directly and unequivocally provides the special definition for the term or phrase.

DEFINITIONS

Integrated Circuit (IC): A set of electronic circuits fabricated on a small piece of semiconductor material, typically silicon. An IC is also referred to as a chip, a microchip, or a die.

Central Processing Unit (CPU): The electronic circuits (i.e., "hardware") that execute the instructions of a computer program (also known as a "computer application" or "application") by performing operations on data that include arithmetic operations, logical operations, and input/output operations.

Microprocessor: An electronic device that functions as a CPU on a single integrated circuit. A microprocessor receives digital data as input, processes the data according to instructions fetched from a memory (either on-die or off-die), and generates results of operations prescribed by the instructions as output. A general purpose microprocessor may be employed in a desktop, mobile, or tablet computer, and is employed for uses such as computation, text editing, multimedia display, and Internet browsing. A microprocessor may also be disposed in an embedded system to control a wide variety of devices including appliances, mobile telephones, smart phones, and industrial control devices.

Microcode: A term employed to refer to a plurality of micro instructions. A micro instruction (also referred to as a "native instruction") is an instruction at the level that a microprocessor sub-unit executes. Exemplary sub-units include integer units, floating point units, MMX units, and load/store units. For example, micro instructions are directly executed by a reduced instruction set computer (RISC) microprocessor. For a complex instruction set computer (CISC) microprocessor such as an x86-compatible microprocessor, x86 instructions are translated into associated micro instructions, and the associated micro instructions are directly executed by a sub-unit or sub-units within the CISC microprocessor.

In view of the above background discussion on mobile station audio subsystems and associated techniques employed within present day mobile stations to deal with excessive noise in the audio chain resulting from a number of causes, a discussion of the limitations and disadvantages of these techniques will now be presented with reference to FIG. 1. Following this, a discussion of the present invention will be provided with reference to FIGS. 2-9. The present invention overcomes the limitations and disadvantages of present day audio subsystems.

Turning to FIG. 1, a block diagram is presented illustrating an exemplary audio subsystem disposed within a present day mobile station 100. As one skilled in the art will appreciate the audio system within a mobile station 100 includes a microphone 111 and a speaker 112. The audio subsystem spans an analog element 120, an audio signal processor 130, a control processor 140, and a modem processor 150. For purposes of the present application, only relevant components are shown within the analog element 120 and the processors 130, 140, 150, as one skilled in the art will appreciate that a mobile station comprises numerous other components that are not directly related to audio reception, processing, and transmission.

Accordingly, in an audio transmission chain, the microphone 111 is coupled to an analog to digital converter (ADC) 121 within the analog element 120, the output of which is provided to a transmit (TX) pre-processor 131 within the audio signal processor 130. The output of the TX pre-processor 131 is coupled to a speech service option (SSO) decoder 133. The output of the SSO decoder 133 is coupled to a reverse channel packet handler 141 within the control processor 140. The output of the reverse channel packet handler 141 is coupled to a channel encoder 151 within the modem processor 150.

In an audio reception chain, a channel decoder 152 within the modem processor 150 is coupled to a forward channel packet handler 142 within the control processor 140. The output of the forward channel packet handler 142 is coupled to an SSO decoder 134 within the audio signal processor 130. The output of the SSO decoder 134 is coupled to a receive (RX) post-processor 132. The output of the RX post-processor 132 is coupled to a digital to analog converter (DAC) 122 within the analog element 120. The output of the DAC 122 is coupled to the speaker 112.

In operation, sound pressure waves in the audio frequency range are converted by the microphone 111 into analog electrical signals that are provided to the ADC 121. The ADC 121 samples the analog electrical signals and coverts them into digital representations of the analog electrical signals, typically pulse code modulation (PCM) signals. In practice, samples are also buffered by the ADC 121 in groups of eight samples or 16 samples, and upon completion of a group, the ADC will issue an transmit interrupt service request (TISR) (not shown) to the audio signal processor 130 to indicate that samples are ready for provision to the TX pre-processor 131.

The TX pre-processor 131 performs audio operations on the PCM signals provided by the ADC 121 known to those skilled in the art to include equalization, automatic gain control (AGC), acoustic compression, and the like, and these pre-processed PCM signals are provided to the SSO encoder 133. The SSO encoder 133 converts the pre-processed PCM signals into transmit audio packets suitable for transmission over a code division multiple access (CDMA) reverse channel, such as that employed by the well known 1xRTT CDMA architecture.

The transmit audio packets are then provided to the reverse channel packet handler 141 within the control processor 140, which controls many other functions within the mobile station, including interface to the modem processor 150. Accordingly, the transmit audio packets are provided to the channel encoder 151 within the modem processor 150, which encodes the transmit audio packets for transmission over a 1xRTT reverse channel air interface to one or more base stations.

In the audio receive chain, forward channel transmissions are received by the mobile station 100 over a 1xRTT forward channel air interface, and are provided to the channel decoder 152. The channel decoder 152 decodes the encoded CDMA packets and provides received audio packets to the forward channel packet handler 142 within the control processor 140. The forward channel packet handler 142, like the reverse channel packet handler 141, performs many functions within the mobile station, one of which is interface to the modem processor 150. The forward channel packet handler 142 thus provides received audio packets to the SSO decoder 134 within the audio signal processor 130. The SSO decoder 134 converts the received audio packets into received PCM signals, which are provided to the RX post-processor 132. The RX post-processor 132, like the TX pre-processor 131, performs audio operations on the PCM signals provided by the SSO decoder 134 known to those skilled in the art to include equalization, automatic gain control (AGC), acoustic decompression, and the like, and these post-processed PCM signals are provided to the DAC 122.

The DAC 122 as well includes buffers (not shown) that allow for buffering of typically eight or 16 post-processor PCM signals, and when buffers are ready to receive additional signals, a receive ISR (not shown) is issued to the audio signal processor 130 to indicate readiness to receive additional signals.

The DAC 122 converts the post-processed PCM signals into analog electrical signals capable of driving the speaker 112, and the speaker 112 converts the analog electrical signals into sound pressure waves in the audio frequency range.

Generally, the noted elements in the audio transmit and receive chain function reliably to allow for transmission and reception of audio signals suitable to support communications by a user of the mobile station over the 1xRTT network with one or more other users, as well as supporting other types of audio transmissions between users and machines. However, the present application focuses on a problem that is well know in the art that is caused by issues corresponding to the interface between the analog element 120 and the audio signal processor 130. As one skilled in the art will appreciate, the interface between the analog element 120 and the audio signal processor 130 is a digital interface. That is, control of both the ADC 121 and the DAC 122 is affected by settings in configuration registers (not shown). For example, the ADC 121 may be configured to take samples of the analog electrical signal on a rising edge, on a falling edge, or it may employ a delayed mode of sampling. The DAC 122 may be configured similarly to interpret PCM signals having a sign bit, or not having a sign bit, etc. And it is one of the functions of the audio processor 130 to configure both the ADC 121 and the DAC 122 dynamically in response to changing audio conditions by changing the settings in the configuration registers to comport with current audio conditions. One skilled in the art will also appreciate that it is not uncommon for the audio signal processor 130 to misconfigure either the ADC 121, the DAC 122, or both the ADC 121 and the DAC 122 in response to changing audio conditions, thus interjecting audible noise into the chains. One skilled in the art will further appreciate that sudden shifts in signals within the audio transmit and receive chains may result in a state where the chains are stressed to the point that audible noise is heard through the speaker 112 or is transmitted over the 1xRTT air interface to another party. Regardless of the cause, this phenomena, though infrequent, is often referred to as "big noise," "excessive noise," or "loud noise," and it is exhibited by noise heard in the speaker 112 in either a transmitting or receiving mobile station such that the noise level significantly interferes with the user's ability to hear true audio through the speaker 112. In addition to big noise, misconfiguration of the ADC 121 and/or the DAC 122, or sudden signal shifts, may result in conditions where audio levels are decreased, even to the point of audio mute. Those phenomena are abnormal. These unexpected behaviors in a mobile station's audio paths may be due to immature software, by inconsistent interface between analog element 120 and the processors 130, 140, or by inconsiderate habits in phone use.

As a result of either of these conditions, a user is required to power cycle the mobile station 100 in order to clear the problem and return the station to acceptable audio levels.

The present inventors have noted that it is cumbersome at best to require a user to power cycle his/her mobile station 100 in order to mitigate the effects of big noise, and they have further provided apparatus and methods that overcome this disadvantage, and others, via an automatic mechanism in a mobile station for recovering from unexpected behaviors in the audio chain. The present invention will now be discussed with reference to FIGS. 2-9.

Figure 2:
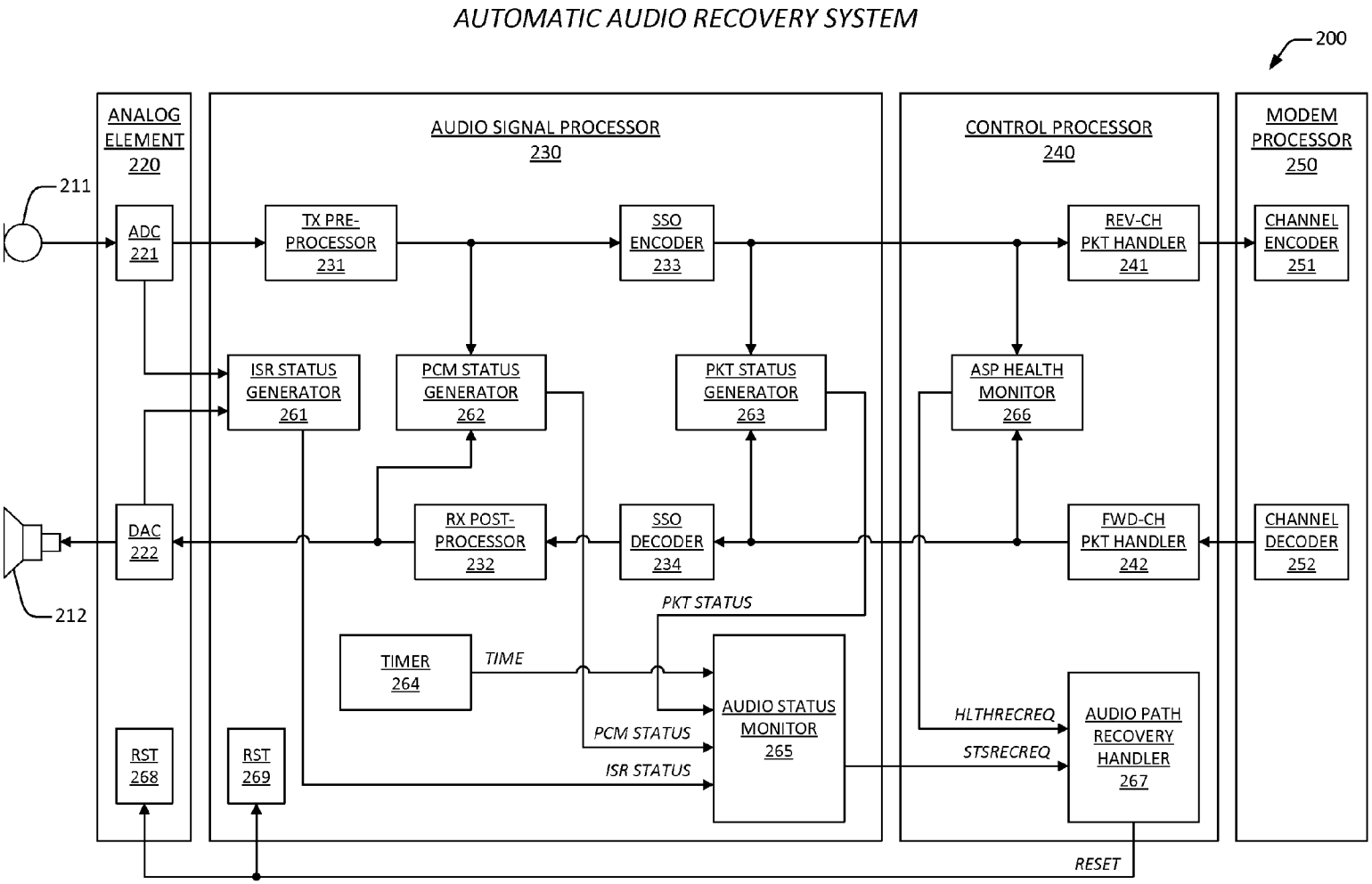
FIG. 2 is a block diagram depicting an audio subsystem within a mobile station according to the present invention featuring an automatic audio recovery mechanism.

Turning to FIG. 2, a block diagram is presented depicting an audio subsystem within a mobile station 200 according to the present invention featuring an automatic audio recovery mechanism. Like the mobile station 100 of FIG. 1, the mobile station 200 according to the present invention has a microphone 211 and a speaker 212, and the audio subsystem spans an analog element 220, an audio signal processor 230, a control processor 240, and a modem processor 250. Like the mobile station 100 of FIG. 1, for purposes of the present application, only relevant components are shown within the analog element 220 and the processors 230, 240, 250, as one skilled in the art will appreciate that a mobile station 200 comprises numerous other components that are not directly related to audio reception, processing, and transmission.

Accordingly, in an audio transmission chain, the microphone 211 is coupled to an analog to digital converter (ADC) 221 within the analog element 220, the output of which is provided to a transmit (TX) pre-processor 231 within the audio signal processor 230. The output of the TX pre-processor 231 is coupled to a speech service option (SSO) decoder 233. The output of the SSO decoder 233 is coupled to a reverse channel packet handler 241 within the control processor 240. The output of the reverse channel packet handler 241 is coupled to a channel encoder 251 within the modem processor 250.

In an audio reception chain, a channel decoder 252 within the modem processor 250 is coupled to a forward channel packet handler 242 within the control processor 240. The output of the forward channel packet handler 242 is coupled to an SSO decoder 234 within the audio signal processor 230. The output of the SSO decoder 234 is coupled to a receive (RX) post-processor 232. The output of the RX post-processor 232 is coupled to a digital to analog converter (DAC) 222 within the analog element 220. The output of the DAC 222 is coupled to the speaker 212.

Beyond the audio transmission and reception chains, the audio signal processor 230 according to the present invention also has an interrupt service request (ISR) status generator 261 that is coupled to both the ADC 221 and the DAC 222. The audio signal processor 230 additionally includes a PCM status generator 262 that is coupled to the outputs of the TX pre-processor 231 and the RX post-processor 232. The audio signal processor 230 further includes a packet status generator 263 that is coupled to the output of the SSO encoder 233 and to the input of the SSO decoder 234. The audio signal processor 230 further includes a timer 264. The outputs of the ISR status generator 261, PCM status generator 262, packet status generator 263, and the timer 264 are each coupled to an audio status monitor 265 via signals ISR STATUS, PCM STATUS, PKT STATUS, and TIME, respectively.

The control processor 240 also includes an audio signal processor (ASP) health monitor 266 that is coupled to the input of the reverse channel packet handler 241 and the output of the forward channel packet handler 242. The control processor 240 additionally has an audio path recovery handler 267 that is coupled to the audio status monitor 265 via signal STSRECREQ and to the ASP health monitor 266 via signal H LTHRECREQ.

The analog element 220 also has reset logic 268 that is coupled to the audio path recovery handler 267 via signal RESET, and the audio signal processor 230 includes reset logic 269 that is coupled to the audio path recovery handler 267 via signal RESET.

In operation, sound pressure waves in the audio frequency range are converted by the microphone 211 into analog electrical signals that are provided to the ADC 221. The ADC 221 samples the analog electrical signals and coverts them into digital representations of the analog electrical signals, typically pulse code modulation (PCM) signals. In practice, samples are also buffered by the ADC 221 in groups of eight samples or 16 samples, and upon completion of a group, the ADC 221 will issue an transmit interrupt service request (TISR) (not shown) to the audio signal processor 230 to indicate that samples are ready for provision to the TX pre-processor 231.

The TX pre-processor 231 performs audio operations on the PCM signals provided by the ADC 221 known to those skilled in the art to include equalization, automatic gain control (AGC), acoustic compression, and the like, and these pre-processed PCM signals are provided to the SSO encoder 233. The SSO encoder 233 converts the pre-processed PCM signals into transmit audio packets suitable for transmission over a CDMA reverse channel, such as that employed by the well known 1xRTT CDMA architecture.

The transmit audio packets are then provided to the reverse channel packet handler 241 within the control processor 240, which controls many other functions within the mobile station, including interface to the modem processor 250. Accordingly, the transmit audio packets are provided to the channel encoder 251 within the modem processor 250, which encodes the transmit audio packets for transmission over a 1xRTT reverse channel air interface to one or more base stations.

In the audio receive chain, forward channel transmissions are received by the mobile station 200 over a 1xRTT forward channel air interface, and are provided to the channel decoder 252. The channel decoder 252 decodes the encoded CDMA packets and provides received audio packets to the forward channel packet handler 242 within the control processor 240. The forward channel packet handler 242, like the reverse channel packet handler 241, performs many functions within the mobile station, one of which is interface to the modem processor 250. The forward channel packet handler 242 thus provides received audio packets to the SSO decoder 234 within the audio signal processor 230. The SSO decoder 234 converts the received audio packets into received PCM signals, which are provided to the RX post-processor 232. The RX post-processor 232, like the TX pre-processor 231, performs audio operations on the PCM signals provided by the SSO decoder 234 known to those skilled in the art to include equalization, automatic gain control (AGC), acoustic decompression, and the like, and these post-processed PCM signals are provided to the DAC 222.

The DAC 222 as well includes buffers (not shown) that allow for buffering of typically eight or 16 post-processor PCM signals, and when buffers are ready to receive additional signals, a receive ISR (not shown) is issued to the audio signal processor 230 to indicate readiness to receive additional signals.

The DAC 222 converts the post-processed PCM signals into analog electrical signals capable of driving the speaker 212, and the speaker 212 converts the analog electrical signals into sound pressure waves in the audio frequency range.

To overcome the limitations alluded to above as big noise, audio mute, and other issues corresponding to misconfiguration of the interface between the analog element 120 and the audio signal processor 130, the ISR status generator 261 is configured to monitor ISRs generated by both the ADC 221 and DAC 222. If the number of ISRs over a prescribed time interval are not commensurate with maintenance of acceptable audio levels, as will be described in more detail below, then the ISR status generator will assert ISR STATUS. The PCM status generator 262 is configured to monitor PCM signals output by both the TX pre-processor 231 and the RX post-processor 232. If the PCM signals within the prescribed time interval are determined to be abnormal, as will be described in more detail below, then the PCM status generator 262 will assert PCM STATUS. The packet status generator 263 is configured to monitor audio packets transmitted to the control processor 240 and received from the control processor 240. If packets appear to be missing within the prescribed time interval, as will be described in more detail below, then the packet status generator 263 will assert PKT STATUS.

The timer 264 is configured to indicate the prescribed time interval during which the status generators 261-263 determine conditions that may indicate abnormalities within the transmit and/or receive audio paths. In one embodiment, the prescribed time interval is approximately 20 milliseconds, and is available to all three status generators 261-263, as well as to the status monitor 265. Another embodiment contemplates a prescribed time interval of approximately 10 milliseconds. In one embodiment, the prescribed time interval repeats continuously as long as there is activity over the transmit and/or receive audio paths, that is, if the transmit and/or receive audio paths are in an "on" state.

Upon assertion of ISR STATUS, PCM STATUS, or PKT STATUS, the audio status monitor 265 asserts STSRECECREQ, indicating a need for recovery of the audio subsystem. Accordingly, the audio path recovery handler asserts RESET, which directs the reset elements 268-269 to initialize all audio components 221-222, 231-234 with the analog element 220 and the audio signal processor 230, respectively, to a previously known stable state, thus returning the audio transmit/receive paths to acceptable audio levels.

In addition to monitoring the audio transmit/receive paths for abnormalities corresponding to ISRs, PCM signaling, and audio packet transmission/reception, the ASP health monitor 266 is configured to monitor the audio signal processor 230 for other communication related abnormalities, as will be described in more detail below, and if abnormalities are detected, then HLTHRECREQ is asserted, directed the audio path recovery handler 267 to assert RESET, which directs the reset elements 268-269 to initialize all audio components 221-222, 231-234 with the analog element 220 and the audio signal processor 230, respectively, to a previously known stable state, thus returning the audio transmit/receive paths to acceptable audio levels.

In contrast to a present day mobile station 100, which requires the user to power cycles in order to correct audio subsystem errors, the mobile station 200 according to the present invention provides for automatic audio subsystem recovery from unexpected behaviors.

Figure 3:
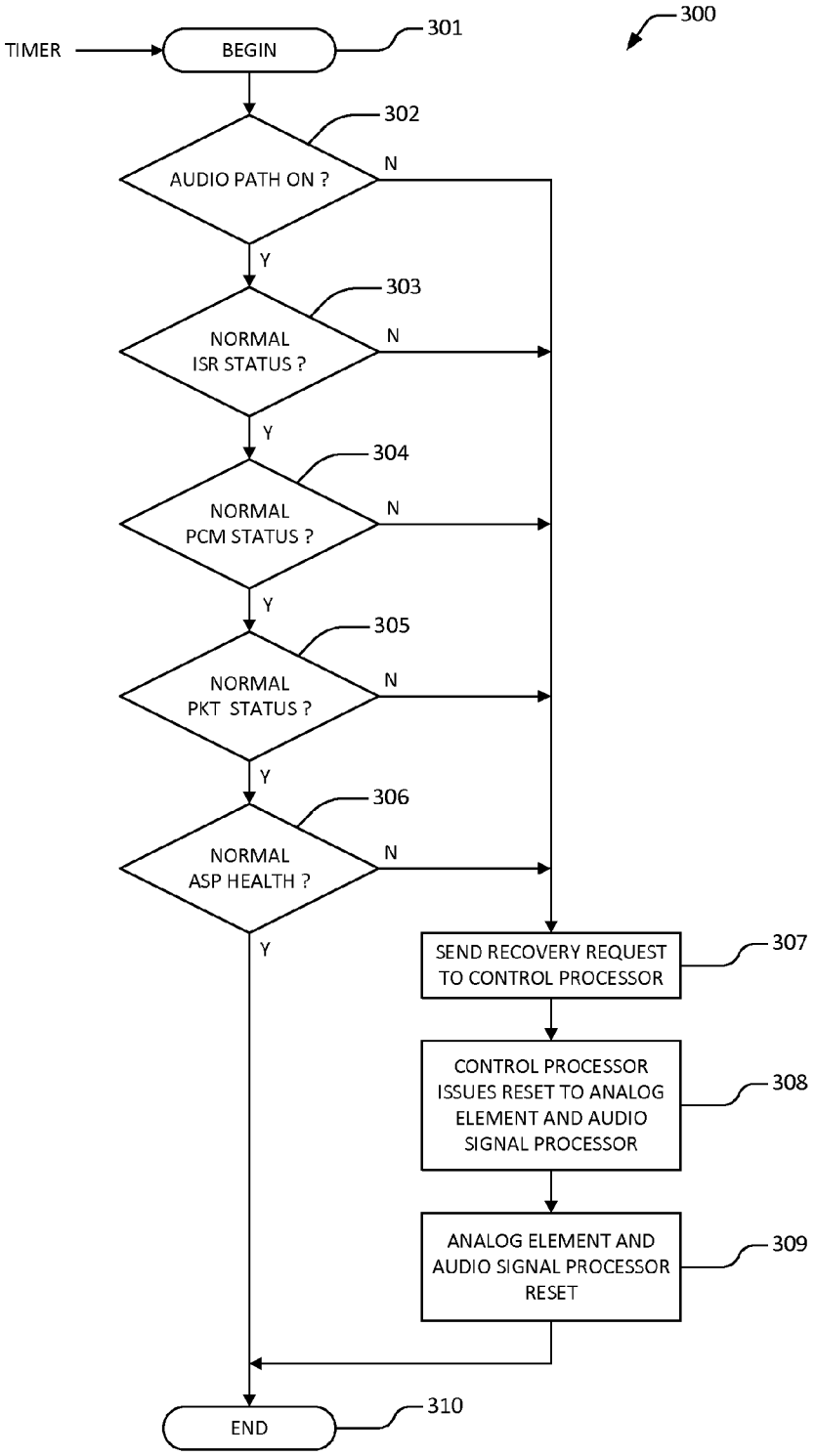
FIG. 3 is a flow diagram featuring a method according to the present invention for monitoring audio status.

Referring now to FIG. 3, a flow diagram 300 is presented featuring a method according to the present invention for monitoring audio status, such as may be employed by elements within the mobile station 200 of FIG. 2. Flow begins at block 301 where signal TIME is asserted by the timer 264, indicating the prescribed time interval during which determinations are made regarding abnormalities within the audio transmit/receive paths. Flow then proceeds to decision block 302.

At decision block 302, an evaluation is made to determine if the audio transmit/receive path is on. If so, then flow proceeds to decision block 303. If not, then flow proceeds to block 307.

At block 303, an evaluation is made to determine if the ISR status is normal, as indicated by the ISR status generator 261. If so, then flow proceeds to decision block 304. If not, then flow proceeds to block 307.

At block 304, an evaluation is made to determine if the PCM status is normal, as indicated by the PCM status generator 262. If so, then flow proceeds to decision block 305. If not, then flow proceeds to block 307.

At block 305, an evaluation is made to determine if the packet status is normal, as indicated by the packet status generator 263. If so, then flow proceeds to decision block 306. If not, then flow proceeds to block 307.

At block 306, an evaluation is made to determine if the audio signal processor health is normal, as indicated by the ASP health monitor 266. If so, then flow proceeds to block 310. If not, then flow proceeds to block 307.

At block 307, recovery requests, i.e., HLTHRECREQ and/or STATRECREQ, may be asserted to the audio path recovery handler 267. Flow then proceeds to block 308.

At block 308, the audio path recovery handler 267 asserts RESET to the reset elements 268-269. Flow then proceeds to block 309.

At block 309, the reset elements 268-269 initialize all audio components 221-222, 231-234 with the analog element 220 and the audio signal processor 230, respectively, to a previously known stable state, thus returning the audio transmit/receive paths to acceptable audio levels. Flow then proceeds to block 310.

At block 310, the method completes.

Figure 4:
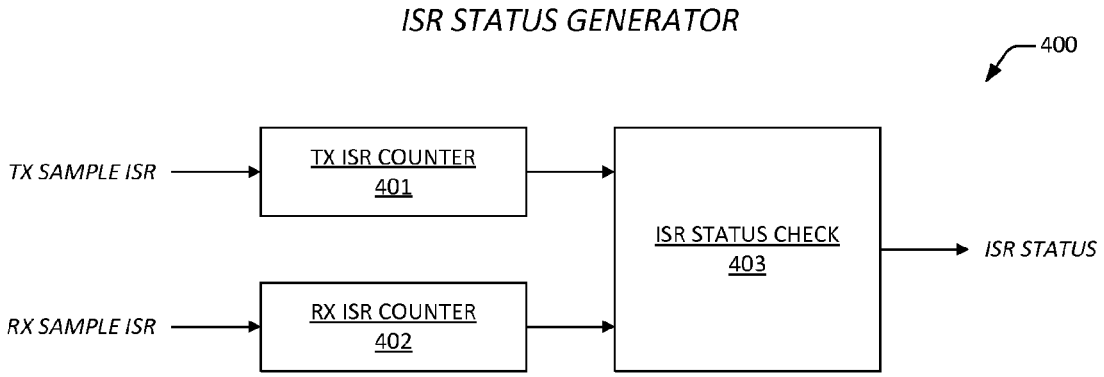
FIG. 4 is a block diagram showing an interrupt service request (ISR) status generator according to the present invention.

Now turning to FIG. 4, a block diagram is presented showing an interrupt service request (ISR) status generator 400 according to the present invention, such as may be employed within the mobile station 200 of FIG. 2. The ISR status generator 400 includes a TX ISR counter 401 that receives a TX SAMPLE ISR signal from the ADC 221, and an RX ISR counter 402 that receives an RX SAMPLE ISR signal from the DAC 222. The counters 401-402 increase according to the number of respective ISRs that are received during the prescribed time interval. The counters 401-402 are coupled to an ISR status check element 403 that determines if the values of the counters 401-402 are commensurate with maintenance of acceptable audio levels, or if they are indicative of abnormalities. If abnormalities are determined, then the check element 403 asserts signal ISR STATUS.

Figure 5:
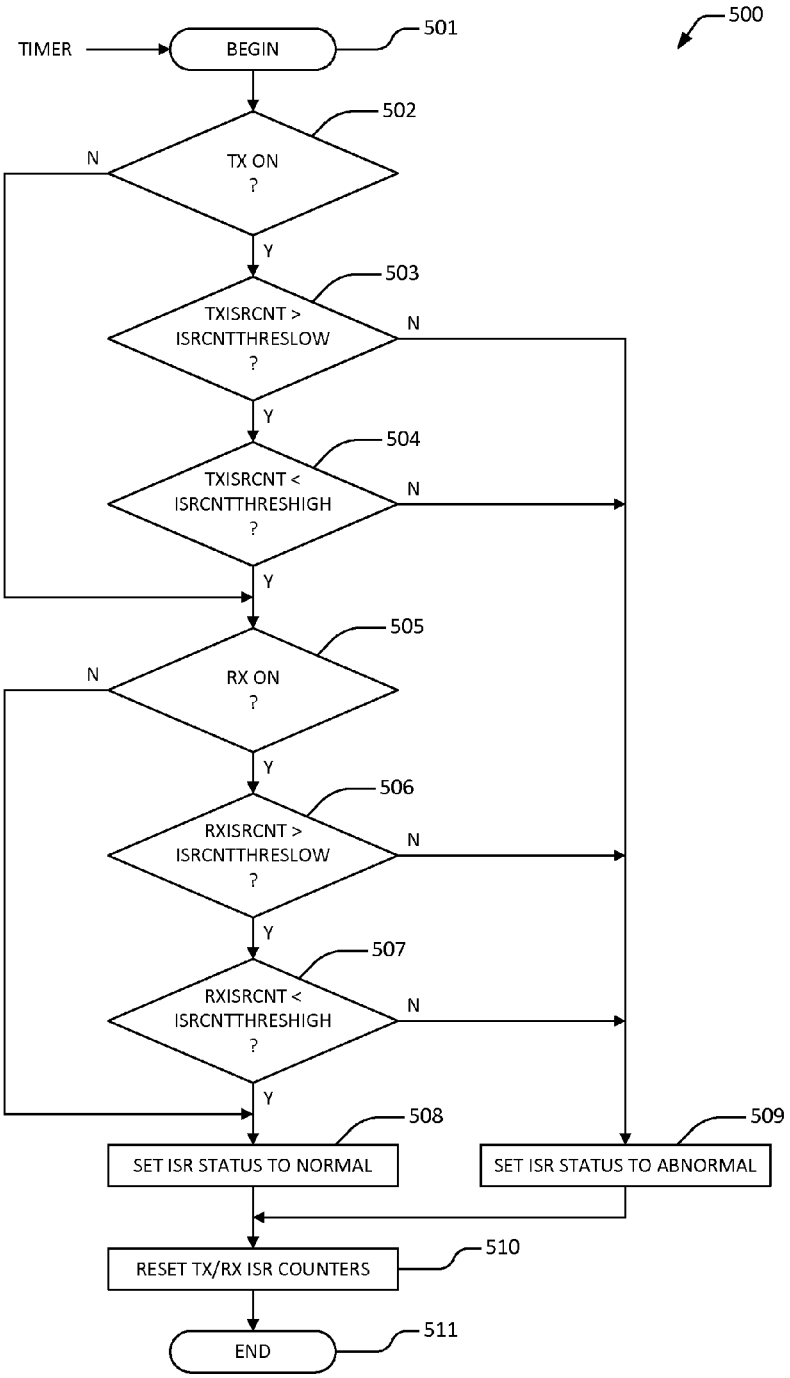
FIG. 5 is a flow diagram illustrating a method according to the present invention for monitoring interrupt service request status.

Referring to FIG. 5, a flow diagram 500 is presented illustrating a method according to the present invention for monitoring interrupt service request status, such as might be executed within the ISR status generator 400 of FIG. 4. Flow begins at block 501, where signal TIME is asserted by the timer 264, indicating the prescribed time interval during which determinations are made regarding abnormalities within the audio transmit/receive paths. Flow then proceeds to decision block 502.

At decision block 502, an evaluation is made to determine if the audio transmit path is on. If so, then flow proceeds to decision block 503. If not, then flow proceeds to decision block 505.

At decision block 503, an evaluation is made to determine if the number of TX ISRs monitored within the prescribed time interval are greater than a first threshold, ISRCNTTHRESLOW. If so, then flow proceeds to decision block 504. If not, then flow proceeds to block 509.

At decision block 504, an evaluation is made to determine if the number of TX ISRs monitored within the prescribed time interval are less than a second threshold, ISRCNT-THRESHIGH. If so, then flow proceeds to decision block 505. If not, then flow proceeds to block 509.

At decision block 505, an evaluation is made to determine if the audio receive path is on. If so, then flow proceeds to decision block 506. If not, then flow proceeds to block 508.

At decision block 506, an evaluation is made to determine if the number of RX ISRs monitored within the prescribed time interval are greater than the first threshold, ISRCNT-THRESLOW. If so, then flow proceeds to decision block 507. If not, then flow proceeds to block 509.

At decision block 507, an evaluation is made to determine if the number of TX ISRs monitored within the prescribed time interval are less than the second threshold, ISRCNT-THRESHIGH. If so, then flow proceeds to block 508. If not, then flow proceeds to block 509.

At block 508, the ISR status generator 400 sets ISR status to normal by deasserting signal ISR STATUS. Flow then proceeds to block 510.

At block 509, the ISR status generator 400 sets ISR status to abnormal by asserting signal ISR STATUS. Flow then proceeds to block 510.

At block 510, the counters 401-402 are reset to initial values. Flow then proceeds to block 511.

At block 511, the method completes.

Figure 6:
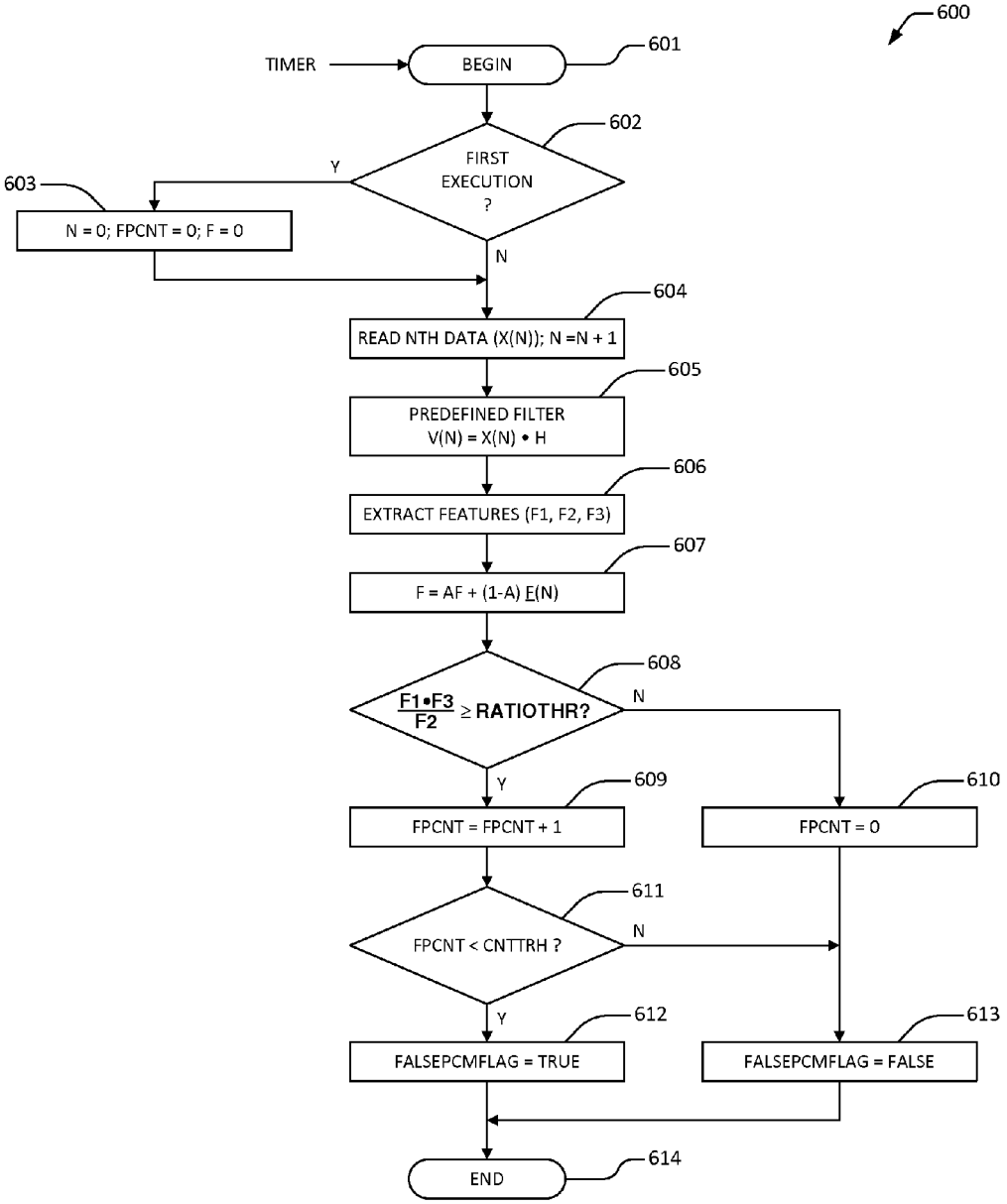
FIG. 6 is a flow diagram detailing a method according to the present invention for monitoring pulse code modulation status.

Referring to FIG. 6, a flow diagram 600 is presented detailing a method according to the present invention for monitoring pulse code modulation (PCM) signal status, such as may be employed by the PCM status generator 262 of FIG. 2. Although both RX and TX path PCM signals are monitored, the flow chart 600 depicts monitoring of an exemplary PCM signal, for clarity purposes. Flow begins at block 601, where signal TIME is asserted by the timer 264, indicating the prescribed time interval during which determinations are made regarding abnormalities within the audio transmit/receive paths. Flow then proceeds to decision block 602.

At decision block 602, an evaluation is made to determine if this status monitoring iteration is a first execution. If so, then flow proceeds to block 603. If not, then flow proceeds to block 604.

At block 603, a frame counter N, a false PCM counter FPCNT, and an accumulated feature set F are initialized to zero in this embodiment. In other embodiments those feature could be set to other values. Flow then proceeds to block 604.

At block 604, a current frame PCM signal X(N) is read and the frame counter N is incremented. Flow then proceeds to block 605.

At block 605, the current frame signal X(N) is filtered by a predefined filter H. The parameters of the filter H are chosen to provide for an output V(N) having predictable characteristics. Flow then proceeds to block 606.

At block 606, the filter output V(N) is transformed into the frequency domain. In the frequency domain, the following features are extracted: which are DC power F1, middle band power F2, and fold-over power F3. Flow then proceeds to block 607.

At block 607, a current feature set $\underline{F}$(N) that was extracted at block 606 is long-term averaged by a $1^{st}$ order autoregressive filter with a forgetting factor A. If the ratio of F1·F3 to F2 is greater than or equal to a ratio threshold RATIOTHR, then flow proceeds to block 609. If the ratio is less than RATIOTHR, then flow proceeds to block 610.

At block 609, the false PCM counter FPCNT is incremented, and flow proceeds to decision block 611.

At block 610, FPCNT is set to zero. Flow then proceeds to block 613.

At decision block 611, an evaluation is made to determine if FPCNT less than a count threshold CNTTRH. If so, then flow proceeds to block 612. If not, then flow proceeds to block 613.

At block 612, a false PCM flag FALSEPCMFLAG is set to true, thus indicating that signal PCM STATUS should be asserted to the audio status monitor 265. Flow then proceeds to block 614.

At block 613, FALSEPCMFLAG is set to false, thus indicating that signal PCM status should be deasserted. Flow then proceeds to block 614.

At block 614, the method completes.

Figure 7:
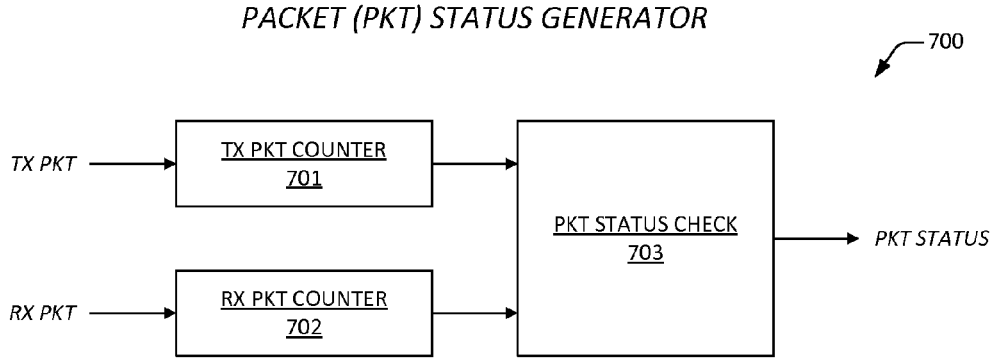
FIG. 7 is a block diagram showing a packet status generator according to the present invention.

Now turning to FIG. 7, a block diagram is presented showing a packet status generator 700 according to the present invention, such as may be employed within the mobile station 200 of FIG. 2. The packet status generator 700 includes a TX packet counter 701 that receives a TX PKT signal from the SSO encoder 233, and an RX packet counter 702 that receives an RX PKT signal from the forward channel packet handler 242. The counters 701-702 increase according to the number of respective packets that are received during the prescribed time interval. The counters 701-702 are coupled to a packet status check element 703 that determines if the values of the counters 701-702 are commensurate with maintenance of acceptable audio levels, or if they are indicative of abnormalities. If abnormalities are determined, then the check element 703 asserts signal PKT STATUS.

Figure 8:
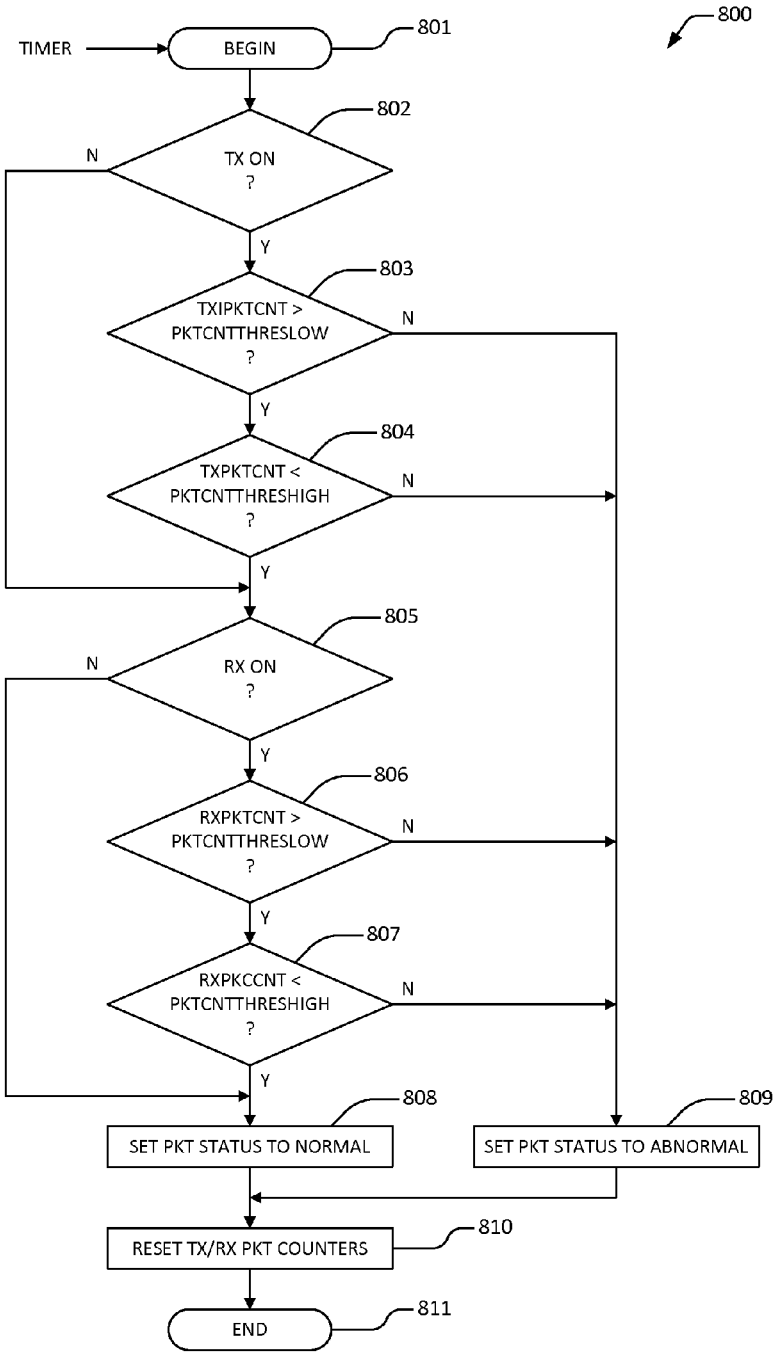
FIG. 8 is a flow diagram illustrating a method according to the present invention for monitoring packet status.

Now turning to FIG. 8, a flow diagram 800 is presented illustrating a method according to the present invention for monitoring packet status, such as might be executed within the packet status generator 700 of FIG. 7. Flow begins at block 801, where signal TIME is asserted by the timer 264, indicating the prescribed time interval during which determinations are made regarding abnormalities within the audio transmit/receive paths. Flow then proceeds to decision block 802.

At decision block 802, an evaluation is made to determine if the audio transmit path is on. If so, then flow proceeds to decision block 803. If not, then flow proceeds to decision block 805.

At decision block 803, an evaluation is made to determine if the number of TX packets monitored within the prescribed time interval are greater than a first threshold, PKTCNT-THRESLOW. If so, then flow proceeds to decision block 804. If not, then flow proceeds to block 809.

At decision block 804, an evaluation is made to determine if the number of packets monitored within the prescribed time interval are less than a second threshold, PKYCNTTHRESHIGH. If so, then flow proceeds to decision block 805. If not, then flow proceeds to block 809.

At decision block 805, an evaluation is made to determine if the audio receive path is on. If so, then flow proceeds to decision block 806. If not, then flow proceeds to block 808.

At decision block 806, an evaluation is made to determine if the number of packets monitored within the prescribed time interval are greater than the first threshold, PKTCNT-THRESLOW. If so, then flow proceeds to decision block 807. If not, then flow proceeds to block 809.

At decision block 807, an evaluation is made to determine if the number of packets monitored within the prescribed time interval are less than the second threshold, PKTCNT-THRESHIGH. If so, then flow proceeds to block 808. If not, then flow proceeds to block 809.

At block 808, the packet status generator 700 sets packet status to normal by deasserting signal PKT STATUS. Flow then proceeds to block 810.

At block 809, the packet status generator 700 sets packet status to abnormal by asserting signal PKT STATUS. Flow then proceeds to block 810.

At block 810, the counters 701-702 are reset to initial values. Flow then proceeds to block 811.

At block 811, the method completes.

Figure 9:
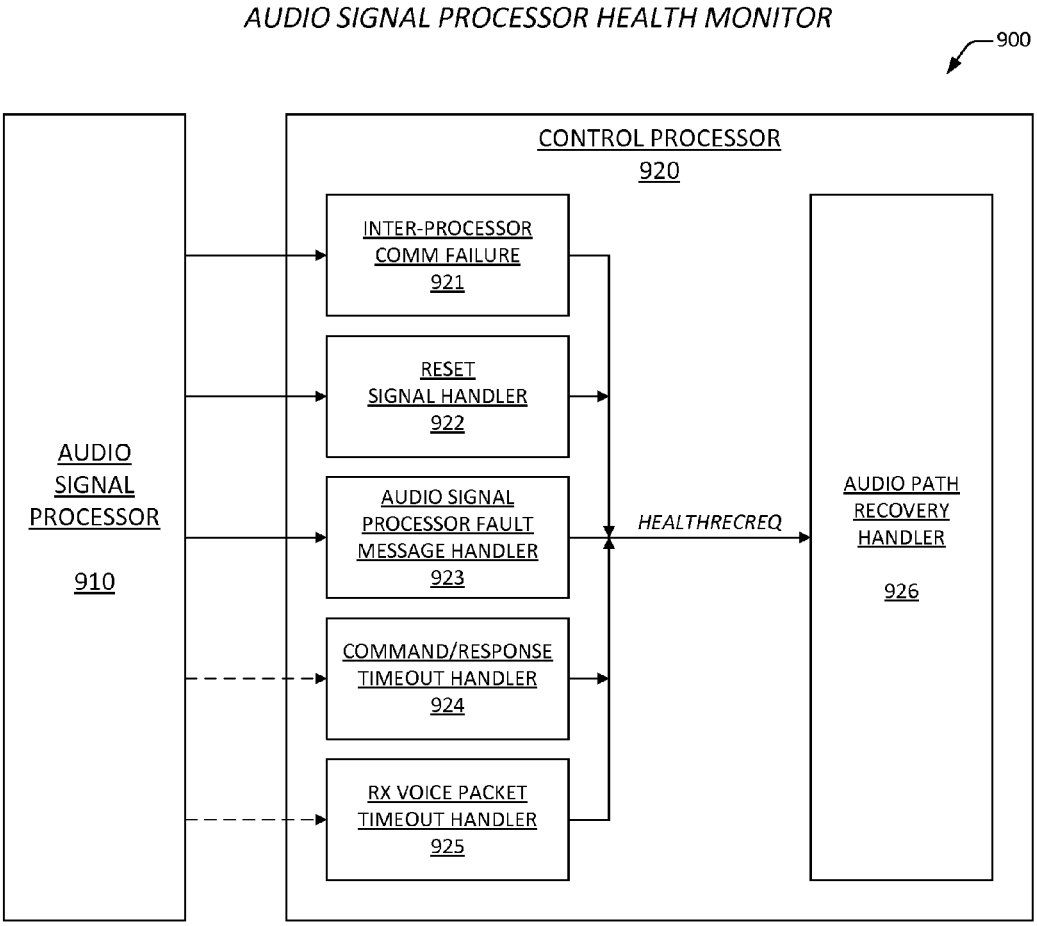
FIG. 9 is a block diagram detailing an audio signal processor health monitor according to the present invention.

Finally referring to FIG. 9, a block diagram 900 is presented detailing an audio signal processor health monitor according to the present invention, such as may be employed in the mobile station 200 of FIG. 2. The health monitor is disposed within a control processor 920 of the mobile station 200 and includes an inter-processor communication failure element 921, a reset signal handler 922, an audio signal processor fault message handler 923, a command/response timeout handler 924, and an RX voice packet timeout handler 925. The health monitor elements 921-925 are coupled to an audio signal processor 910 within the mobile station 200 and to an audio path recovery handler 926 via signal HEALTHRECREQ.

Operationally, HEALTHRECREQ is asserted if any of the following conditions are detected:

- a communication failure in the hardware level handshake between the audio signal processor 910 and the control processor 920 is detected by the inter-processor communication failure element 921;
- an audio signal processor reset triggers a reset indication to be sent to the control processor 920, and the indication is detected by the reset signal handler 922;
- the audio signal processor 910 sends a message to the control processor 920 indicating that an unrecoverable fault has occurred, which is detected by the audio signal processor fault message handler 923;
- the control processor 920 sends a command to the audio signal processor 910 and does not receive the expected response within a specified time interval, which is detected by the command/response timeout handler 924; and
- reverse channel voice packets are not received by the control processor 920 while the audio path is active, as is detected by the RX voice packet timeout handler 925.

Upon assertion of HEALTHRECREQ, the recovery handler 926 will assert RESET, which directs the reset elements 268-269 to initialize all audio components 221-222, 231-234 with the analog element 220 and the audio signal processor 230, respectively, to a previously known stable state, thus returning the audio transmit/receive paths to acceptable audio levels.

The mobile station 200 according to the present invention is configured to perform the functions and operations as discussed above. The mobile station 200 comprises logic, circuits, devices, or microcode (i.e., micro instructions or native instructions), or a combination of logic, circuits, devices, or microcode, or equivalent elements that are employed to execute the functions and operations according to the present invention as noted. The elements employed to accomplish these operations and functions within the mobile station 200 may be shared with other circuits, microcode, etc., that are employed to perform other functions and/or operations within the mobile station 200. According to the scope of the present application, microcode is a term employed to refer to a plurality of micro instructions. A micro instruction (also referred to as a native instruction) is an instruction at the level that a unit executes. For example, micro instructions are directly executed by a reduced instruction set computer (RISC) microprocessor. For a complex instruction set computer (CISC) microprocessor, such as an x86-compatible microprocessor, x86 instructions are translated into associated micro instructions, and the associated micro instructions are directly executed by a unit or units within the CISC microprocessor.

Portions of the present invention and corresponding detailed description are presented in terms of software, or algorithms and symbolic representations of operations on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" or "displaying" or the like, refer to the action and processes of a computer system, a microprocessor, a central processing unit, or similar electronic computing device, that manipulates and transforms data represented as physical, electronic quantities within the computer system's registers and memories into other data similarly represented as physical quantities within the computer system memories or registers or other such information storage, transmission or display devices.

Note also that the software implemented aspects of the invention are typically encoded on some form of program storage medium or implemented over some type of transmission medium. The program storage medium may be electronic (e.g., read only memory, flash read only memory, electrically programmable read only memory), random access memory magnetic (e.g., a floppy disk or a hard drive) or optical (e.g., a compact disk read only memory, or "CD ROM"), and may be read only or random access. Similarly, the transmission medium may be metal traces, twisted wire pairs, coaxial cable, optical fiber, or some other suitable transmission medium known to the art. The invention is not limited by these aspects of any given implementation.

The particular embodiments disclosed above are illustrative only, and those skilled in the art will appreciate that they can readily use the disclosed conception and specific embodiments as a basis for designing or modifying other structures for carrying out the same purposes of the present invention, and that various changes, substitutions and alterations can be made herein without departing from the scope of the invention as set forth by the appended claims.

What is claimed is:

1. An automatic audio recovery system in a mobile device, the system comprising:

one or more status generators, configured to monitor operation of a plurality of audio path elements within the mobile device, and configured to detect and report one or more abnormal audio operations to an audio status monitor, wherein, responsive to one or more reports corresponding to said one or more abnormal audio operations, said audio status monitor requests automatic recovery of said plurality of audio path elements; and an audio path recovery handler, configured to receive an automatic recovery request from said audio status monitor, and configured to responsively direct a plurality of reset elements corresponding to said plurality of audio path elements to automatically initialize said plurality of audio path elements to a stable state.

2. The apparatus as recited in claim 1, wherein said one or more status generators comprise:

a interrupt service request status generator, coupled to an analog-to-digital converter (ADC) and to a digital-to-analog converter (DAC), configured to monitor interrupt service requests (ISRs) from said ADC and said DAC to an audio signal processor within the mobile device, and configured to report abnormal ISR activity if the number of ISRs fall outside of a prescribed normal ISR range.

3. The apparatus as recited in claim 1, wherein said one or more status generators comprise:

a packet status generator, coupled to a selective service option (SSO) encoder and to a forward channel packet handler within the mobile device, configured to monitor audio packets transmitted by said SSO encoder and received from said forward channel packet handler, and configured to report abnormal audio packet activity if the number of audio packets fall outside of a prescribed normal audio packet range.

4. The apparatus as recited in claim 1, wherein said one or more status generators comprise:

a pulse code modulation (PCM) status generator, coupled to transmit (TX) pre-processor and to a receive (RX) post-processor within the mobile device, configured to monitor PCM signal frames transmitted by said TX pre-processor and said RX post-processor, and configured to process said PCM signal frames to generate corresponding features, and configured to report abnormal PCM signal activity if said features indicate that said PCM signal frames contributing to said one or more abnormal operations.

5. The apparatus as recited in claim 4, wherein said features comprise auto regressively filtered direct current power, mid-band power, and fold-over power.

6. The apparatus as recited in claim 1, further comprising:

an audio signal processor health monitor, configured to monitor operation of an audio signal processor (ASP) within the mobile device, and configured to detect and report abnormal ASP operation to said audio path recovery handler, wherein, responsive to an abnormal ASP operation report corresponding to abnormal ASP operation, said audio path recovery handler direct said reset elements to automatically initialize said plurality of audio path elements to said previously known stable state.

7. The apparatus as recited in claim 6, wherein said audio signal processor health monitor comprises:

an inter-processor communication failure element, configured to detect a communication failure in a hardware level handshake between said audio signal processor and a control processor;

a reset signal handler, configured to detect a reset indication sent to said control processor by said ASP;

an audio signal processor fault message handler, configured to detect a message to said control processor from said ASP indicating that an unrecoverable fault has occurred;

a command/response timeout handler, configured to determine that a command sent by said control processor to said ASP has not received an expected response within a specified time interval; and a receive (RX) voice packet timeout handler, configured to determine that reverse channel voice packets are not received by said control processor said plurality of audio path elements are active.

8. An automatic audio recovery system in a mobile device, the system comprising:

an audio signal processor (ASP), comprising:

one or more status generators, configured to monitor operation of a plurality of audio path elements within the mobile device, and configured to detect and report one or more abnormal audio operations to an audio status monitor, wherein, responsive to one or more reports corresponding to said one or more abnormal audio operations, said audio status monitor requests automatic recovery of said plurality of audio path elements; and a control processor, comprising:

an audio path recovery handler, configured to receive an automatic recovery request from said audio status monitor, and configured to responsively direct reset elements corresponding to said plurality of audio path elements to automatically initialize said plurality of audio path elements to a stable state.

9. The apparatus as recited in claim 8, wherein said one or more status generators comprise:

a interrupt service request status generator, coupled to an analog-to-digital converter (ADC) and to a digital-to-analog converter (DAC), configured to monitor interrupt service requests (ISRs) from said ADC and said DAC to said ASP, and configured to report abnormal ISR activity if the number of ISRs fall outside of a prescribed normal ISR range.

10. The apparatus as recited in claim 8, wherein said one or more status generators comprise:

a packet status generator, coupled to a selective service option (SSO) encoder and to a forward channel packet handler within the mobile device, configured to monitor audio packets transmitted by said SSO encoder and received from said forward channel packet handler, and configured to report abnormal audio packet activity if the number of audio packets fall outside of a prescribed normal audio packet range.

11. The apparatus as recited in claim 8, wherein said one or more status generators comprise:

a pulse code modulation (PCM) status generator, coupled to transmit (TX) pre-processor and to a receive (RX) post-processor within said ASP, configured to monitor PCM signal frames transmitted by said TX pre-processor and said RX post-processor, and configured to process said PCM signal frames to generate corresponding features, and configured to report abnormal PCM signal activity if said features indicate that said PCM signal frames contributing to said one or more abnormal operations.

12. The apparatus as recited in claim 11, wherein said features comprise auto regressively filtered DC power, mid-band power, and fold-over power.

13. The apparatus as recited in claim 8, wherein said control processor further comprises:

an audio signal processor health monitor, configured to monitor operation of said ASP, and configured to detect and report abnormal ASP operation to said audio path recovery handler, wherein, responsive to an abnormal ASP operation report corresponding to abnormal ASP operation, said audio path recovery handler direct said reset elements to automatically initialize said plurality of audio path elements to said stable state.

14. The apparatus as recited in claim 13, wherein said audio signal processor health monitor comprises:

an inter-processor communication failure element, configured to detect a communication failure in a hardware level handshake between said audio signal processor and said control processor;

a reset signal handler, configured to detect a reset indication sent to said control processor by said ASP;

an audio signal processor fault message handler, configured to detect a message to said control processor from said ASP indicating that an unrecoverable fault has occurred;

a command/response timeout handler, configured to determine that a command sent by said control processor to said ASP has not received an expected response within a specified time interval; and a receive (RX) voice packet timeout handler, configured to determine that reverse channel voice packets are not received by said control processor said plurality of audio path elements are active.

15. A method for automatic recovery from unexpected audio path behaviors in a mobile device, the method comprising:

via one or more status generators, first monitoring operation of a plurality of audio path elements within the mobile device, and first detecting and first reporting one or more abnormal audio operations to an audio status monitor, wherein, responsive to one or more reports corresponding to the one or more abnormal audio operations, the audio status monitor requests automatic recovery of the plurality of audio path elements; and via an audio path recovery handler, receiving an automatic recovery request from the audio status monitor, and responsively directing reset elements corresponding to the plurality of audio path elements to automatically initialize the plurality of audio path elements to a stable state.

16. The method as recited in claim 15, wherein the one or more status generators comprise:

a interrupt service request status generator, coupled to an analog-to-digital converter (ADC) and to a digital-to-analog converter (DAC), configured to monitor interrupt service requests (ISRs) from the ADC and the DAC to an audio signal processor within the mobile device, and configured to report abnormal ISR activity if the number of ISRs fall outside of a prescribed normal ISR range.

17. The method as recited in claim 15, wherein the one or more status generators comprise:

a packet status generator, coupled to a selective service option (SSO) encoder and to a forward channel packet handler within the mobile device, configured to monitor audio packets transmitted by the SSO encoder and received from the forward channel packet handler, and configured to report abnormal audio packet activity if the number of audio packets fall outside of a prescribed normal audio packet range.

18. The method as recited in claim 15, wherein the one or more status generators comprise:

a pulse code modulation (PCM) status generator, coupled to transmit (TX) pre-processor and to a receive (RX) post-processor within the mobile device, configured to monitor PCM signal frames transmitted by the TX pre-processor and the RX post-processor, and configured to process the PCM signal frames to generate corresponding features, and configured to report abnormal PCM signal activity if the features indicate that the PCM signal frames contributing to the one or more abnormal operations.

19. The method as recited in claim 18, wherein the features comprise auto regressively filtered DC power, mid-band power, and fold-over power.

20. The method as recited in claim 15, further comprising:

via an audio signal processor health monitor, second monitoring operation of an audio signal processor (ASP) within the mobile device, and second detecting and second reporting abnormal ASP operation to the audio path recovery handler, wherein, responsive to an abnormal ASP operation report corresponding to abnormal ASP operation, the audio path recovery handler direct the reset elements to automatically initialize the plurality of audio path elements to the stable state.

21. The method as recited in claim 20, wherein the audio signal processor health monitor comprises:

an inter-processor communication failure element, configured to detect a communication failure in a hardware level handshake between the audio signal processor and a control processor;

a reset signal handler, configured to detect a reset indication sent to the control processor by the ASP;

an audio signal processor fault message handler, configured to detect a message to the control processor from the ASP indicating that an unrecoverable fault has occurred;

a command/response timeout handler, configured to determine that a command sent by the control processor to the ASP has not received an expected response within a specified time interval; and a receive (RX) voice packet timeout handler, configured to determine that reverse channel voice packets are not received by the control processor the plurality of audio path elements are active.

* * * * *